US005522782A

United States Patent [19]

Kurtin et al.

[11] Patent Number: 5,522,782

[45] Date of Patent: Jun. 4, 1996

[54] APPARATUS FOR SUPPORTING A SMALL CHILD ADAPTED TO ALLOW LINEAR AND ROTATIONAL MOVEMENT

[76] Inventors: Dragan Kurtin; Miro Kurtin, both of 2712 Beaver Turn, Seaford, N.Y. 11783

[21] Appl. No.: 223,040

[22] Filed: Apr. 5, 1994

[51] Int. Cl.[6] ..... A47D 13/04

[52] U.S. Cl. ..... 482/66; 280/87.051; 297/5

[58] Field of Search ..... 482/66, 67, 68, 482/69; 434/255, 247; 280/87.051; 297/5, 136, 137, 138, 139

[56] References Cited

U.S. PATENT DOCUMENTS

| | | | |
|---|---|---|---|
| 839,681 | 12/1906 | Voigt, Sr. | 482/66 X |
| 841,700 | 1/1907 | Linden | 482/66 X |
| 1,294,300 | 2/1919 | Noel, Sr. | 297/138 X |
| 2,496,748 | 2/1950 | Pond | 434/247 X |
| 2,766,464 | 10/1956 | Savi | 297/136 X |
| 5,302,163 | 4/1994 | Fermaglich et al. | 482/66 |
| 5,407,246 | 4/1995 | Meeker et al. | 297/137 |
| 5,451,093 | 9/1995 | Petrie et al. | 482/66 X |

FOREIGN PATENT DOCUMENTS

| | | | |
|---|---|---|---|
| 549544 | 6/1993 | European Pat. Off. | 297/5 |
| 565454 | 1/1924 | France | 482/68 |
| 596738 | 10/1925 | France | 482/66 |
| 1018712 | 1/1953 | France | 482/66 |
| 661535 | 11/1951 | United Kingdom | 482/66 |

*Primary Examiner*—Peter M. Cuomo
*Assistant Examiner*—David E. Allred

[57] ABSTRACT

A frame having vertically extending corner posts and horizontal rails therebetween in a rectangular configuration. A support plate positionable in a horizontal orientation with parallel lateral side edges and a circular hole through the center thereof. A child seat positioned within the hole of the support plate. Linear bearing surfaces formed by horizontal slots on facing surfaces of the horizontal rails and the lateral edges of the support plate received within the slots to allow for the smooth linear sliding movement of the plate with respect to the frame. A circular bearing surface formed between the inner edge of the hole and the outer edge of the seat to allow smooth rotational movement of the seat.

2 Claims, 4 Drawing Sheets

FIG 5
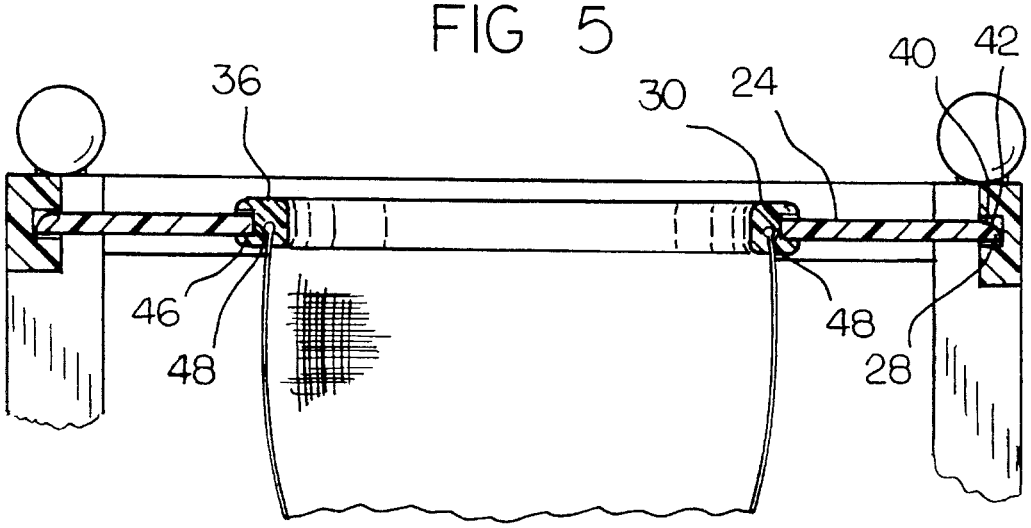
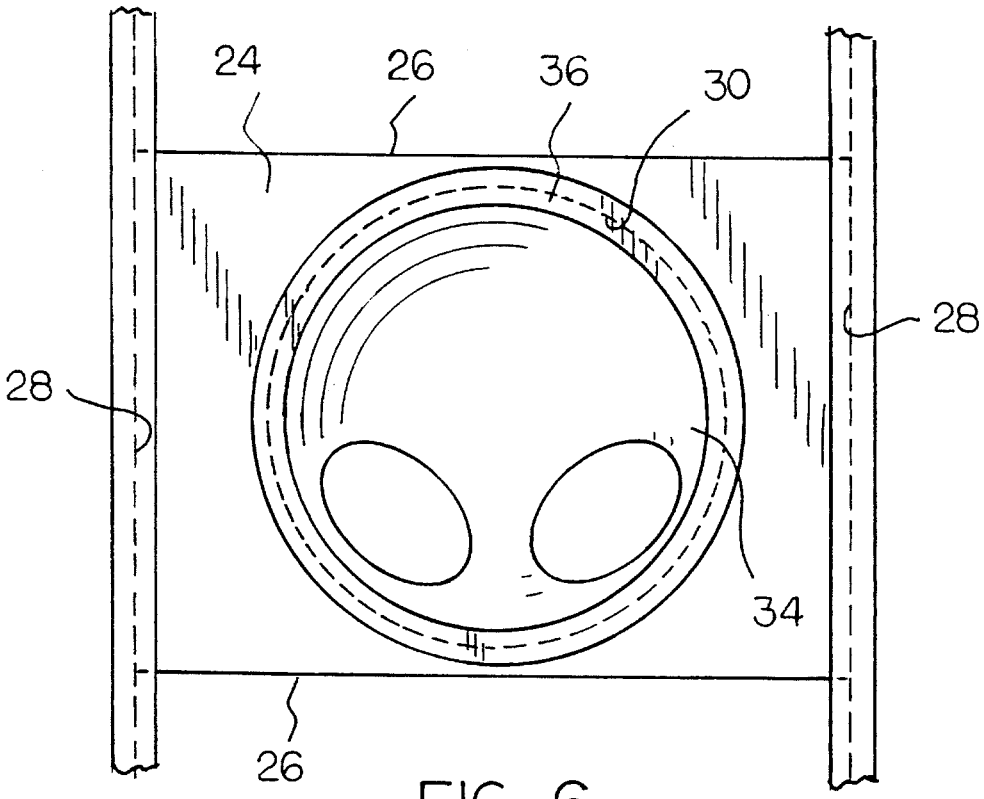
FIG 6

54
52
54
52
52
52
52
54
54

APPARATUS FOR SUPPORTING A SMALL CHILD ADAPTED TO ALLOW LINEAR AND ROTATIONAL MOVEMENT

BACKGROUND OF THE INVENTION

1. Field of the Invention

The present invention relates to apparatus for supporting a small child adapted to allow linear and rotational movement and more particularly pertains to supporting a child in a seat while allowing the child to walk and rotate within the seat with respect to the frame for entertainment and exercise of the child.

2. Description of the Prior Art

The use of child seats which allow for exercise and entertainment is known in the prior art. More specifically, child seats which allow for exercise and entertainment heretofore devised and utilized for the purpose of supporting a child in a seat so as the child may exercise and entertain itself are known to consist basically of familiar, expected, and obvious structural configurations, notwithstanding the myriad of designs encompassed by the crowded prior art which has been developed for the fulfillment of countless objectives and requirements.

By way of example, the prior art discloses in U.S. Pat. No. 5,050,504 to Mulcaster a baby walker with safety track feature.

U.S. Pat. No. 4,621,804 to Mueller discloses a therapeutic roller/walker.

U.S. Pat. No. 4,252,063 to Brooks, Jr. discloses a support walker for orthopedic patients.

U.S. Pat. No. 3,985,082 to Barac an electric walker.

U.S. Pat. No. 3,721,437 to Skaricic a walking trainer.

In this respect, the apparatus for supporting a small child adapted to allow linear and rotational movement according to the present invention substantially departs from the conventional concepts and designs of the prior art, and in doing so provides an apparatus primarily developed for the purpose of supporting a child in a seat while allowing the child to walk and rotate within the seat with respect to the frame for entertainment and exercise of the child.

Therefore, it can be appreciated that there exists a continuing need for new and improved apparatus for supporting a small child adapted to allow linear and rotational movement which can be used for supporting a child in a seat while allowing the child to walk and rotate within the seat with respect to the frame for entertainment and exercise of the child. In this regard, the present invention substantially fulfills this need.

SUMMARY OF THE INVENTION

In view of the foregoing disadvantages inherent in the known types of child seats which allow for exercise and entertainment now present in the prior art, the present invention provides an improved apparatus for supporting a small child adapted to allow linear and rotational movement. As such, the general purpose of the present invention, which will be described subsequently in greater detail, is to provide a new and improved apparatus for supporting a small child adapted to allow linear and rotational movement and method which has all the advantages of the prior art and none of the disadvantages.

To attain this, the present invention essentially comprises a frame having vertically extending corner posts and horizontal rails therebetween in a rectangular configuration, the frame also including a base. A support plate positionable in a horizontal orientation with parallel lateral side edges and a circular hole through the center thereof. A child seat positioned within the hole of the support plate for receiving a child to be supported therein. Linear bearing surfaces formed by horizontal slots on facing surfaces of the horizontal rails and the lateral edges of the support plate received within the slots to allow for the smooth sliding movement of the plate with respect to the frame. A circular bearing surface formed between the inner edge of the hole and the outer edge of the seat to effect smooth rotational movement of the seat and child therein with respect to the plate and frame. Releasable coupling means between the posts, rails and base to allow for the convenient collapse and assembly of the frame.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent of legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide new and improved apparatus for supporting a small child adapted to allow linear and rotational movement which have all the advantages of the prior art child seats which allow for exercise and entertainment and none of the disadvantages.

It is another object of the present invention to provide new and improved apparatus for supporting a small child adapted to allow linear and rotational movement which may be easily and efficiently manufactured and marketed.

It is further object of the present invention to provide new and improved apparatus for supporting a small child adapted to allow linear and rotational movement which are of durable and reliable constructions.

An even further object of the present invention is to provide new and improved apparatus for supporting a small child adapted to allow linear and rotational movement which are susceptible of a low cost of manufacture with regard to both materials and labor, and which accordingly are then susceptible of low prices of sale to the consuming public, thereby making such apparatus for supporting a small child adapted to allow linear and rotational movement economically available to the buying public.

Still yet another object of the present invention is to provide new and improved apparatus for supporting a small child adapted to allow linear and rotational movement which provide in the apparatuses and methods of the prior art some of the advantages thereof, while simultaneously overcoming some of the disadvantages normally associated therewith.

Still another object of the present invention is to supporting a child in a seat while allowing the child to walk and rotate within the seat with respect to the frame for entertainment and exercise of the child.

Lastly, it is an object of the present invention to provide new and improved frame having vertically extending corner posts and horizontal rails therebetween in a rectangular configuration. A support plate positionable in a horizontal orientation with parallel lateral side edges and a circular hole through the center thereof. A child seat positioned within the hole of the support plate. A linear bearing surfaces formed by horizontal slots on facing surfaces of the horizontal rails and the lateral edges of the support plate received within the slots to allow for the smooth sliding movement of the plate with respect to the frame. A circular bearing surface formed between the inner edge of the hole and the outer edge of the seat to allow smooth rotational movement of the seat.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 5 is a cross-sectional view taken along line 5—5 of FIG. 3.

FIG. 6 is a top elevational view taken along line 6—6 of FIG. 4.

The same reference numerals refer to the same parts throughout the various Figures.

DESCRIPTION OF THE PREFERRED EMBODIMENT

Figure 1:
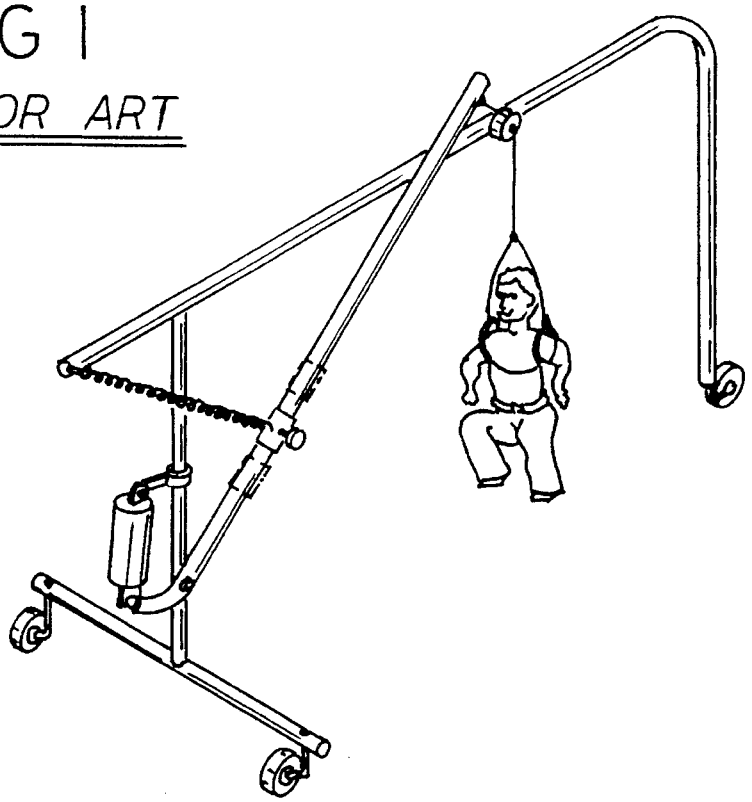
FIG 1 PRIOR ART
FIG. 1 is a perspective illustration of a prior art device for supporting a child while the child is learning to walk.
Figure 2:
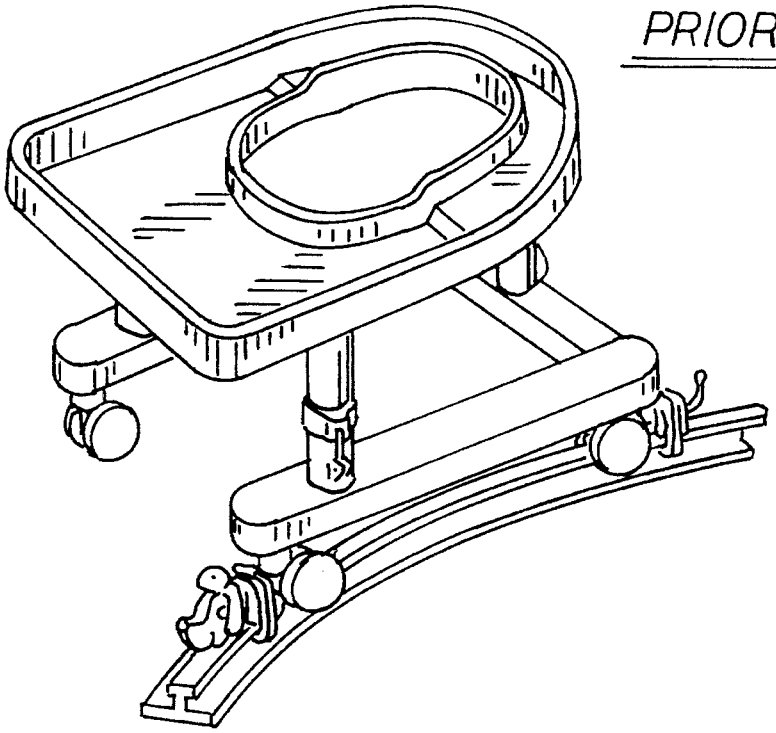
FIG 2 PRIOR ART
FIG. 2 is another prior art device for supporting a child while the child is learning to walk.
Figure 3:
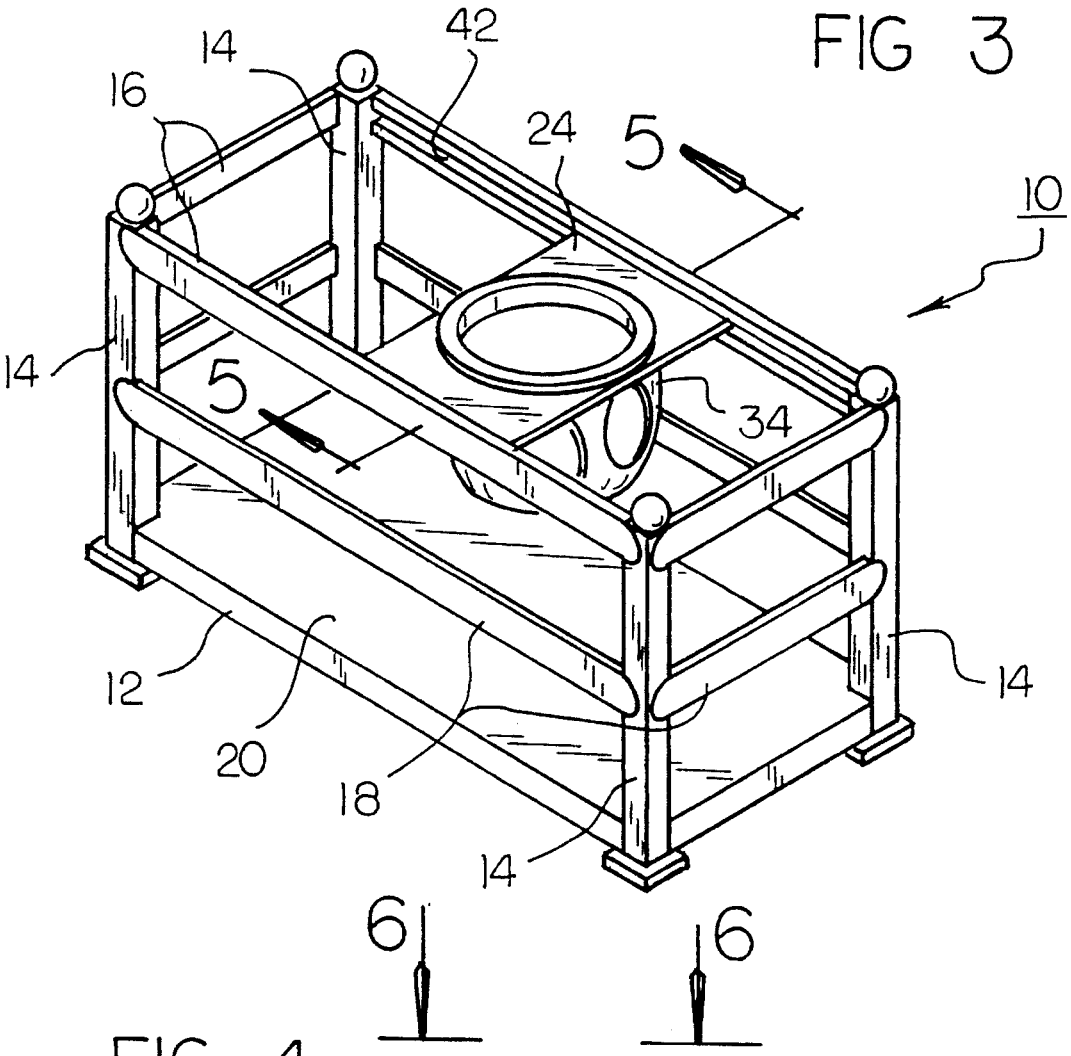
FIG. 3 is a perspective illustration of a the preferred embodiment of the new and improved apparatus for supporting a small child adapted to allow linear and rotational movement constructed in accordance with the principles of the present invention.

With reference now to the drawings, and in particular to FIG. 3 thereof, the preferred embodiment of the new and improved apparatus for supporting a small child adapted to allow linear and rotational movement embodying the principles and concepts of the present invention and generally designated by the reference numeral 10 will be described.

The present invention, the new and improved apparatus for supporting a small child adapted to allow linear and rotational movement is comprised of a plurality of components. In their broadest context, such components include a frame, a support plate, a child seat, linear bearing surfaces, a circular bearing surface, and releasable coupling means for the frame. Such components are individually configured and correlated with respect to each other so as to attain the desired objectives.

More specifically, the frame 12 constitutes the largest component of the system 10. The frame is comprised of four vertically extending corner posts 14. Upper horizontal rails 16 and lower horizontal rails 18 are coupled between the corner posts in a rectangular configuration. Stability is thus provided. Further stability is provided through the use of a rectangular base 20 coupled to the corner posts beneath the horizontal rails at the lower extents of the vertical corner posts.

Next provided is a horizontally disposed support plate 24. The support plate has long longitudinal edges 26 which are parallel with each other and short parallel side edges 28. The edges are configured in a rectangular configuration. Centrally located within the support plate is a hole 30.

Figure 4:
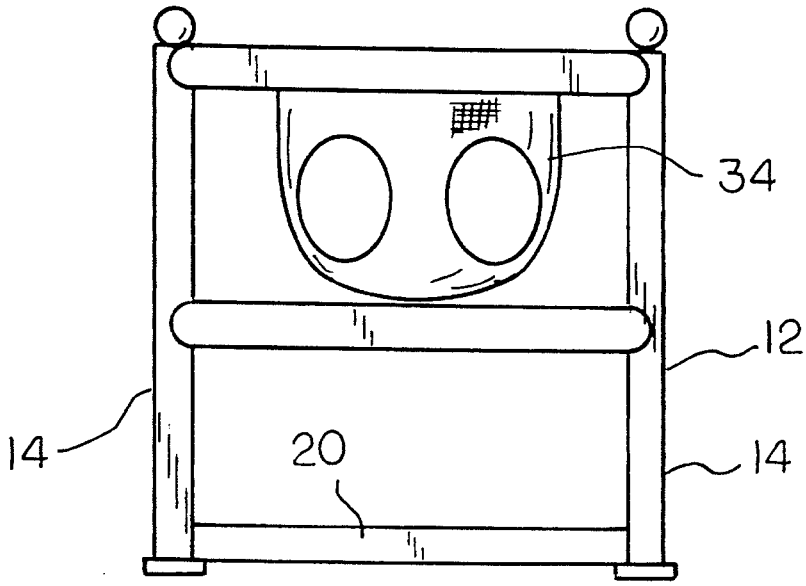
FIG. 4 is a front elevational view of the device illustrated in FIG. 3.
Figure 7:
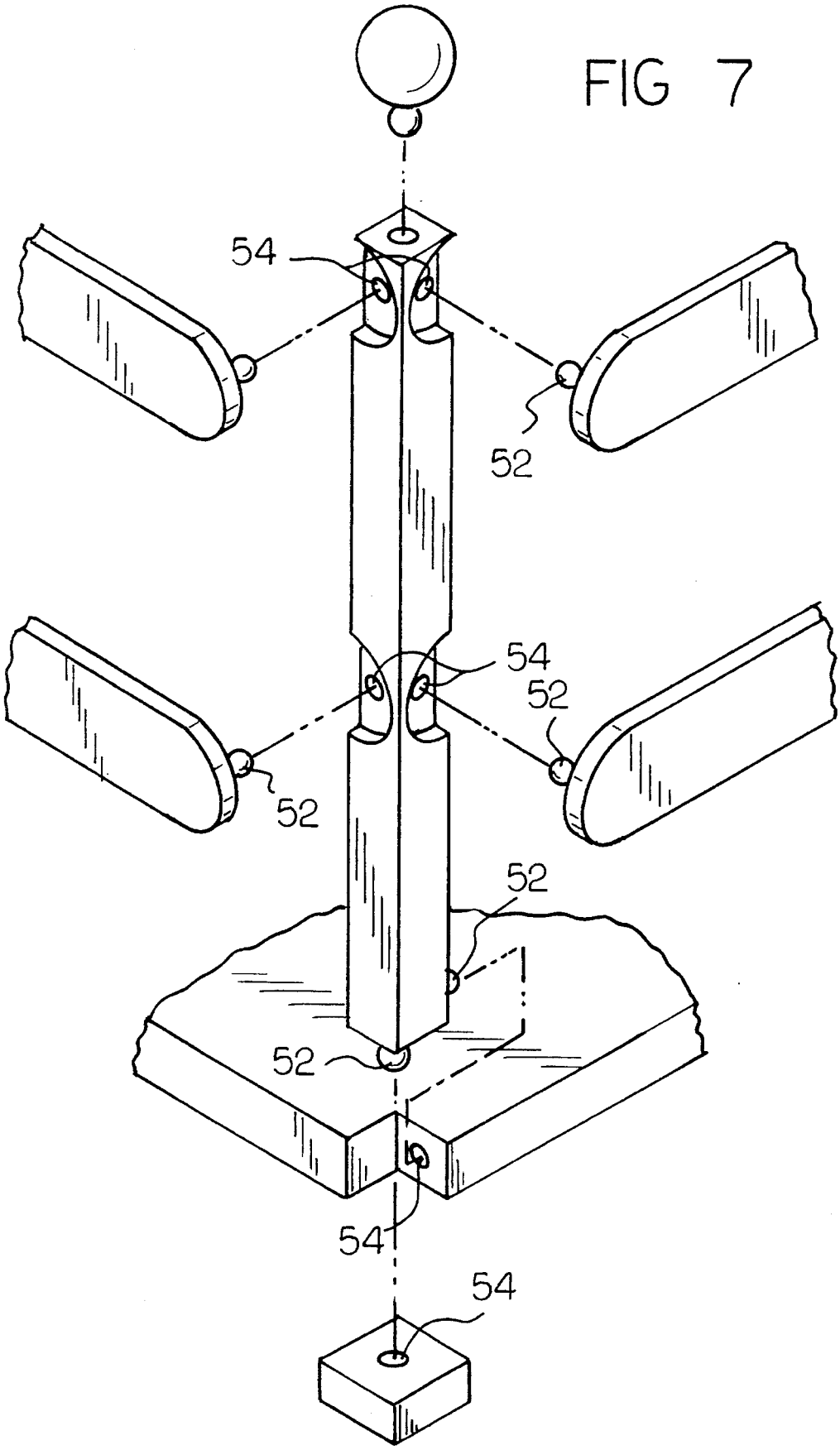
FIG. 7 is an exploded perspective view of the coupling of the components of the base of the device shown in FIGS. 3 and 4.

Positioned within the hole is a child seat 34. The seat is centrally positioned within the hole and is provided with a rigid circular support 36 at its upper extent. Such support has a horizontal recess in a circular configuration facing outwardly. The child seat 34 as shown in FIGS. 4 through 6, includes a hemi-spherical supporting web having an upper annular edge which is coupled to and extends downwardly from the circular support member 36. The supporting web includes a pair of leg apertures directed therethrough permitting projection of legs of an individual through the supporting web when an individual such as a child is positioned therein.

Linear bearing surfaces 40 are provided for the sliding motion of the plate with respect to the frame. Such linear bearing surfaces include horizontal slots 42 on facing surfaces of the upper horizontal rails in cooperation with the lateral edges of the support plate. Such lateral edges of the support plate are received within the slots. This allows for the smooth sliding movement of the plate with respect to the frame. A lubricous bearing surface as of teflon or the like may be provided in the recess or the lateral edges of the support plate or on both to further facilitate the sliding motion therebetween.

In addition to the linear bearing surfaces, a circular bearing surface 46 is also provided. The circular bearing surface is formed between the inner edge 48 of the hole and the outer edge of the seat. Both such components of the bearing surfaces being circular of an essentially common diameter, this will allow the smooth rotational movement of the seat and child therein with respect to the plate and frame. As in the linear bearing surfaces, a lubricous material such as a layer of teflon may be provided on the interior surface of the hole and/or the exterior surface of the recess at the upper edge of the seat.

The last component of the system is a releasable coupling components, such components include pins 52 and recesses 54 to allow for the press-fit between the posts, rails and base. This allows for the convenient disassembly and collapse of the frame for storage as well as its assembly for operation and use.

The present invention is a novel device used to teach small children to walk. It is very advantageous to use for various reasons. First, it confines the child to walk in an area that is visible to their guardians and is safe from hazards. The walker does not move across the floor, like most walkers, instead a supportive sear moves along a track in the device. This design prevents many accidents that commonly occur when using other walkers, such as falling down stairs, sticking fingers in electrical sockets, and similar accidents. The present invention consists of members and components that are easy to assemble and disassemble, making it easier to transport when desired. Another advantage is that toys can be attached to the sides and ends of the device. These create an incentive for the child to walk back and forth from one extreme to the other, while remaining within the apparatus for supporting a small child adapted to allow linear and rotational movement. The cloth seat can rotate 360 degrees, to permit the occupant to turn freely to any desired orientation.

The present invention has a relatively simple design. It is composed of four square posts, four spheres, four square bases, one rectangular seat holder, a material seat, two tracks, and twelve support members. A sphere is attached to the top of each of the four two inch square posts and a square base is attached to the bottom. Next, a rectangular base frame composed of two short support members and two long support members is constructed. Each support member assembles into the square posts parallel to the opposite member, forming the rectangular base. The other support members are arranged in the same fashion, and positioned above the base rectangular frame. A track is located on the inner surface of the top lateral members. This track supports a rectangular seat and allows it to travel along the length of the frame. A circle is cut out of the seat to accommodate a cloth seat and a small child. The child may be secured in the seat with adjustable straps to assure that he cannot climb out of the seat.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An apparatus for supporting a small child comprising:

a frame having a plurality of vertically extending posts positioned in a spaced and parallel orientation; a first upper horizontal rail extending substantially orthogonally from a first one of the posts to a second one of the posts; a second upper horizontal rail extending substantially orthogonally from a third one of the posts to a fourth one of the posts; third upper horizontal rail extending substantially orthogonally from the first one of the posts to the third one of the posts; and a fourth upper horizontal rail extending substantially orthogonally from the second one of the posts to the fourth one of the posts, with a length of the third and fourth upper horizontal rails being substantially greater than a length of the first and second upper horizontal rails, the third and fourth rails each including a slot directed into an interior surface thereof and longitudinally along the length of the respective rail, the slots residing within a common plane, the posts each being shaped so as to define a plurality of upper pin recesses directed thereinto, said posts each being further shaped so as to define a plurality of semi-circular upper rail end recesses directed thereinto with the upper pin recesses each residing within an individual one of the semi-circular upper rail end recesses; and further wherein the ends of each of the upper horizontal rails are shaped so as to define a semi-circular end with the semi-circular ends of each of the upper horizontal rails being cooperatively received within an individual one of the semi-circular,upper rail end recesses;

a planar support plate having spaced and parallel side edges, the side edges being received within the slots of the third and fourth upper rails so as to slidably mount the support plate extending between the third and fourth upper rails, the support plate being shaped so as to define a center circular aperture directed therethrough;

a child seat rotatably mounted within the center circular aperture and extending below the support plate, the child seat including a circular support member having an annular outer recess directed circumferentially about an exterior thereof, with an inner peripheral edge of the support plate being received within said annular outer recess of the circular support member so as to rotatably couple the circular support member to the support plate within the center circular aperture thereof; and a hemispherical supporting web having an upper annular edge coupled to and extending downwardly from the circular support member, the supporting web including a pair of leg apertures directed therethrough permitting projection of legs of an individual through the supporting web;

upper releasable coupling means extending between each of the posts and the rails for releasably coupling the upper horizontal rails to the respective posts, the upper releasable coupling means comprising a plurality of upper pins extending from opposed ends of the upper horizontal rails, with each of the upper pins being received within an individual one of the upper pin recesses of the respective post to removably couple the respective upper horizontal rail thereto;

said frame further comprising a first lower horizontal rail extending substantially orthogonally from the first one of the posts to the second one of the posts; a second lower horizontal rail extending substantially orthogonally from the third one of the posts to the fourth one of the posts; a third lower horizontal rail extending substantially orthogonally from the first one of the posts to the third one of the posts; and a fourth lower horizontal rail extending substantially orthogonally from the second one of the posts to the fourth one of the posts, with a length of the third and fourth lower horizontally substantially greater than a length of the first and second lower horizontal rails, the lower horizontal rails extending in a spaced and substantially parallel orientation relative to the upper horizontal rails;

said posts being each shaped so as to define a plurality of lower pin recesses directed thereinto; and further comprising lower releasable coupling means extending between each of the posts and the lower horizontal rails for releasably coupling the lower horizontal rails to the respective posts, the lower releasable coupling means comprising a plurality of lower pins extending from opposed ends of the lower horizontal rails, with each of the lower pins being received within an individual one of the lower pin recesses of the respective post to removably couple the respective lower horizontal rail thereto; and, wherein the posts are each further shaped so as to define a plurality of semi-circular lower rail end recesses directed thereinto, with the lower pin recesses each residing within an individual one of the semi-circular lower rail end recesses; and further wherein the ends of each of the lower horizontal rails are shaped so as to define a semi-circular end, with the semi-circular ends of each of the lower horizontal rails being cooperatively received within an individual one of the semi-circular lower rail end recesses.

2. The apparatus for supporting a small child of claim 1, wherein the frame further comprises a substantially planar base member extending substantially orthogonally between the posts, with the lower horizontal rails residing between the upper horizontal rails and the base member.

* * * * *